US006814375B2

(12) United States Patent
Cox et al.

(10) Patent No.: US 6,814,375 B2
(45) **Date of Patent: *Nov. 9, 2004**

(54) INTEGRATED PLASTICIZED CARD IN A PAPER CARRIER AND METHOD OF MANUFACTURE

(75) Inventors: Christopher Robert Cox, Orangeville (CA); Thomas MacDonald, Toronto (CA); Thomas Carrigan, Scarborough (CA); William Dale Ritchie, Richmond (CA)

(73) Assignee: Relizon Canada, Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/973,044

(22) Filed: Oct. 10, 2001

(65) Prior Publication Data

US 2002/0041093 A1 Apr. 11, 2002

Related U.S. Application Data

(63) Continuation-in-part of application No. 09/684,129, filed on Oct. 10, 2000.

(51) Int. Cl.[7] ..... B42D 15/00

(52) U.S. Cl. ..... 283/61; 283/81; 283/101; 283/106; 428/40.1; 428/42.1; 428/43

(58) Field of Search ..... 283/61, 62, 74, 283/75, 81, 82, 94, 98, 101, 105, 106, 107; 428/40.1, 41.7, 42.1, 42.2, 42.3, 43

(56) References Cited

U.S. PATENT DOCUMENTS

| | | | | | |
|---|---|---|---|---|---|
| 4,982,337 | A | * | 1/1991 | Burr et al. | 221/7 |
| 5,131,686 | A | | 7/1992 | Carlson | |
| 5,509,693 | A | * | 4/1996 | Kohls | 283/75 |
| 5,529,345 | A | * | 6/1996 | Kohls | 283/101 |
| 5,687,087 | A | * | 11/1997 | Taggart | 235/381 |
| 5,842,722 | A | * | 12/1998 | Carlson | 283/107 |
| 5,895,074 | A | * | 4/1999 | Chess et al. | 283/107 |
| 6,022,051 | A | * | 2/2000 | Casagrande | 283/107 |
| 6,039,356 | A | * | 3/2000 | Warther et al. | 283/61 |
| 6,159,570 | A | * | 12/2000 | Ulrich et al. | 283/109 |
| 6,179,201 | B1 | * | 1/2001 | Chess | 229/92.1 |
| 6,224,109 | B1 | * | 5/2001 | Yang | 283/57 |
| 6,299,530 | B1 | * | 10/2001 | Hansted et al. | 206/449 |
| 6,306,475 | B1 | * | 10/2001 | Stocq et al. | 428/345 |
| 6,322,655 | B1 | * | 11/2001 | Casagrande | 156/257 |

* cited by examiner

*Primary Examiner*—Monica S. Carter
(74) *Attorney, Agent, or Firm*—Jacobson Holman PLLC

(57) ABSTRACT

A carrier sheet with an integrated card and preferably, but not exclusively, a magnetic strip card is described. The sheet contains printed information which is in part card information printed at a predetermined location on a front face of a carrier sheet in a card region thereof and oriented to be disposed on an outer surface of the front and a rear card panel of the card to be formed. The siliconized liner patch, containing a pressure-sensitive adhesive, is laminated on the back surface of the carrier sheet and disposed to extend over the card region. A face patch of clear poly material containing a magnetic strip is immovably secured over the card region on the front face of the paper carrier sheet. A die cut delineates card contour panels and a straight fold line separates the panel whereby they may be folded together when detached from the carrier sheet with the pressure-sensitive adhesive of the liner being transferred to the rear surface of the panels so that the panels can be folded together with their rear surface stuck together. The method of manufacture and a method of use is also described herein.

10 Claims, 5 Drawing Sheets

INTEGRATED PLASTICIZED CARD IN A PAPER CARRIER AND METHOD OF MANUFACTURE

CROSS-REFERENCE TO RELATED APPLICATION

This application is a continuation-in-part of application Ser. No. 09/684,129, filed Oct. 10, 2000.

TECHNICAL FIELD

The present invention relates to a carrier sheet form having an integrated card having opposed plasticized surfaces and preferably, but not exclusively, a magnetic strip card, and the method of manufacture and use.

BACKGROUND ART

It is known to provide carrier sheets having detachable cards printed thereon with the contour of the card being die cut and retained in the sheet or form by friction or uncut regions about the card. As discussed in U.S. Pat. No. 5,131,686 is it also known to manufacture identification cards produced as embossed plastic cards and plain paper cards. However, embossed cards are relatively expensive to make, while plain paper cards are inexpensive. The problem with paper cards is that they are not long lasting and do not convey a polished image on their outer surface. The image can be chipped off paper fibers and these cards are not water resistant.

To make plastic cards, it is necessary to utilize plastic-coated paper and these are produced on an impact printer and the printing has relatively poor quality and are unable to form quality bar codes and graphics on such cards. Plastic sheets are also environmentally wasteful as most of the sheet is not utilized after the card is detached and they are also costly and produce a recycling problem. Often, these cards also fall off the carrier sheets. Paper-handling machines and printers have problems with handling sheets of uneven thickness, such as sheets carrying cards and portions thereof and often will jam in the machine resulting in costly maintenance and destruction of the paper stock. This is much more serious if the printing consists of personalized information as this would require resetting the machine and the computer and analyzing the printed forms to determine which have to be destroyed. In summary, previous attempts have been made using laser or ionographic printers and have failed to produce acceptable carrier sheets bearing plastic die cut identification cards.

In an attempt to remedy this problem, U.S. Pat. No. 5,131,686 discloses a method and a sheet stock wherein the layer of printable plastic is adhered to a portion of an upper surface of a sheet and a second layer of paper or plastic is adhered over the remainder portion of the upper surface of the sheet, whereby the sheet is of substantially uniform thickness and can be handled in a printing process of the laser type, ionographic or ink jet type. However, this method is costly due to the fact that another sheet needs to be adhered to the large remaining portion of the carrier sheet.

SUMMARY OF INVENTION

It is a feature of the present invention to provide a carrier sheet with an integrated printed card having opposed card panels which, when folded and glued together, has opposed plasticized surfaces and preferably, but not exclusively, a magnetic strip card, and which substantially overcomes the above-mentioned disadvantages of the prior art.

Another feature of the present invention is to provide a method of forming a carrier sheet having an integrated detachable magnetic strip card having opposed plasticized surfaces and which substantially overcomes the above-mentioned disadvantages of the prior art.

Another feature of the present invention is to provide a novel method of booking a travel event using a carrier sheet with an integrated magnetic strip card having a user code encoded on the magnetic strip and wherein the carrier sheet contains personal printed information.

Another feature of the present invention is to provide a carrier sheet having an integrated magnetic strip card formed by two plasticized panels containing printed information and a magnetic strip and an adhesive backing wherein when said panels are detached from said sheets and folded on a straight interconnecting fold line, said panels are juxtaposed at their rear surface and glued together, whereby said card is plasticized on the front and rear surface thereof.

Another feature of the present invention is to provide a carrier sheet according to the above described feature, wherein the magnetic strip is provided on a third plasticized panel integrated in the carrier sheet, whereby the third plasticized panel has an adhesive backing and is folded over an interconnecting fold line to form the plasticized card.

According to the above features, from a broad aspect, the present invention provides a carrier sheet with an integrated card. The carrier sheet has printed information thereon. The printed information contains in part card information printed at a predetermined location on a front face of the carrier sheet in a card region of the sheet and oriented to be disposed on an outer surface of a front and a rear card panel of a card to be formed. A siliconized liner patch, containing a pressure-sensitive adhesive surface, is laminated on a back surface of the carrier sheet and disposed to extend over the card region. A face patch of clear poly material is immovably secured over the card region on the front face of the carrier sheet. A die cut delineates the front and rear panels disposed adjacent one another and extends through the face patch and carrier sheet. The die cut card panels are retained in the carrier sheet by the pressure-sensitive adhesive of the siliconized liner patch. A straight fold line is formed in the face patch to form a fold line between the front and rear card panels. The card is formable by peeling off the front and rear card panels from the carrier sheet with the pressure-sensitive adhesive releasing from the siliconized liner patch whereby the adhesive now lies on a back face of the front and rear card panels. The panels are folded along the straight fold line to secure the back face of the panels containing the adhesive together.

According to a further broad aspect of the present invention, there is provided a carrier sheet as described above wherein a magnetic strip patch is immovably secured over the card region on an outer face of a magnetic strip panel. The die cut also delineates the magnetic strip panel adjacent the front panel. A straight fold line is formed in the face patch between the magnetic strip and the front card panels. The card is formable by peeling off the panels from the carrier sheet with the pressure-sensitive adhesive releasing from the siliconized liner patch whereby the adhesive now lies on a back face of the card panels, and folding the panels along the straight fold lines to firstly mate the back face of the front and rear card panels together and then the back face of the magnetic strip panel on the rear card panel.

According to a further broad aspect of the present invention, there is a provided a method of forming a carrier sheet having an integrated detachable card. The method comprises the steps of printing a carrier sheet with information containing in part card information printed at a predetermined location on the front face of the carrier sheet in a card region of the carrier sheet and oriented to be disposed on an outer surface of the front and a rear card panel of a magnetic strip card to be formed. A siliconized liner patch, containing a pressure-sensitive adhesive surface, is applied on a back surface of the carrier sheet and attached by said adhesive to extend over the card region. A face patch of clear poly material containing a magnetic strip is secured over the card region on the front face of the carrier sheet. The front and rear card panels are then die cut about their peripheries. The die cut extends through the face patch and the carrier sheet, whereby the die cut card panels are adjacent to one another and solely retained in the carrier sheet by the pressure-sensitive adhesive on the siliconized liner patch on the back surface of the carrier sheet. When detached, the panels are folded along a straight fold line which is formed in the face patch between the adjacent front and rear card panels, whereby to permit the adjacent card panels to be folded and stuck together on their back faces along the fold line when adjacent die cut card panels are pulled off the silicone liner patch and carry the pressure-sensitive adhesive on their back surface.

According to a further broad aspect of the present invention, there is a provided a method of forming a carrier sheet as described above, wherein a magnetic strip patch is secured over the card region on the front face of the carrier sheet when securing the face patch of clear poly material thereon, wherein a magnetic strip panel is die cut with the front and rear card panels, and wherein a straight fold line is formed between the front card panel and the magnetic strip panel to permit them to be folded together.

According to a still further broad aspect of the present invention, there is provided a method of booking a travel event comprising receiving a customer identity and a personal event request. The customer identity information and an event schedule information customized to the request is stored in a computer. A carrier sheet containing an integral magnetic strip card is automatically addressed to the customer and the magnetic strip card is encoded with a user code to access the stored information at an event location. The carrier sheet with the integral magnetic strip card which has been encoded is then forwarded to the customer who detaches the card. The customer enters the card in a magnetic strip card reader at the event location whereby the stored information is automatically accessed by identifying the user code to record the arrival of the customer at the event location and automatically print additional personalized information that may be available to the customer only at the event location for use by the customer.

BRIEF DESCRIPTION OF THE DRAWINGS

A preferred embodiment of the present invention will now be described with reference to the accompanying drawings in which.

DESCRIPTION OF PREFERRED EMBODIMENTS

Figure 4:
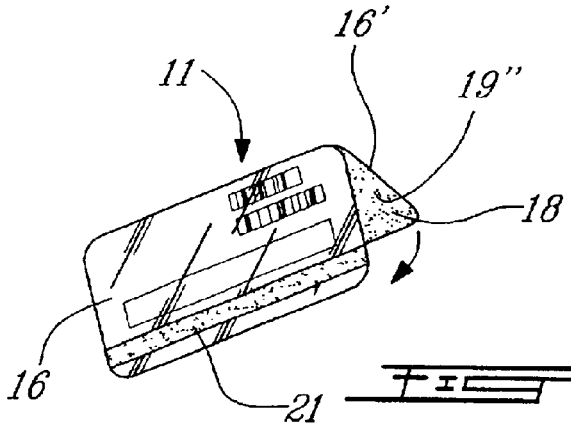
FIG. 4 is a perspective view showing how the card panels are folded together to form a plasticized card.

Referring now to the drawings and more particularly to FIGS. 1 and 6 through 8 there is shown a carrier sheet 10, which could be formed of paper or suitable synthetic material, and having an integrated magnetic strip card 11, herein two cards 11 and 11' formed integral with the carrier sheet 10. The carrier sheet has printed information 12 printed thereon as well as card information 13 printed thereon at a predetermined card location on the front face 14 of the carrier sheet. The lower portion of the carrier sheet is a card region 20 and the printed information 13 is oriented to be disposed on an outer surface 15 of a front and rear panel 16 and 16' respectively which forms the magnetic strip card 11 and as more clearly shown in FIG. 5 after the panels are folded together as also shown in FIG. 4.

Figure 6:
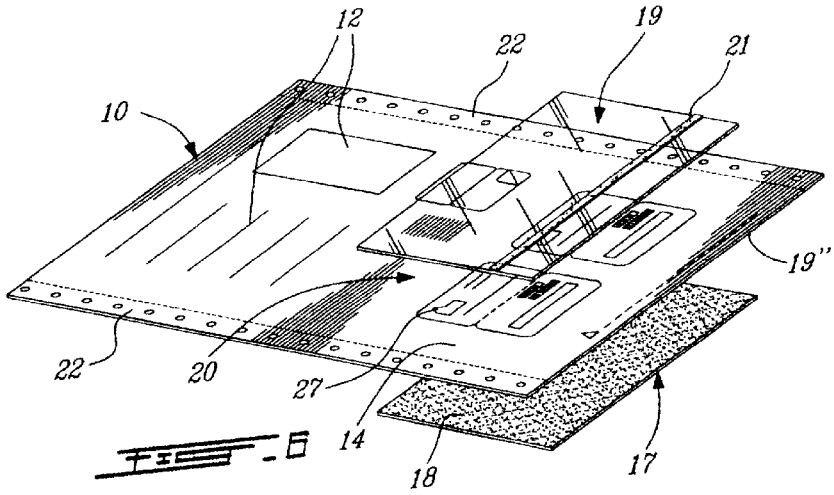
FIG. 6 is a partly exploded perspective view showing the construction of the carrier sheet with two integrated magnetic strip cards being formed thereon.
Figure 7:
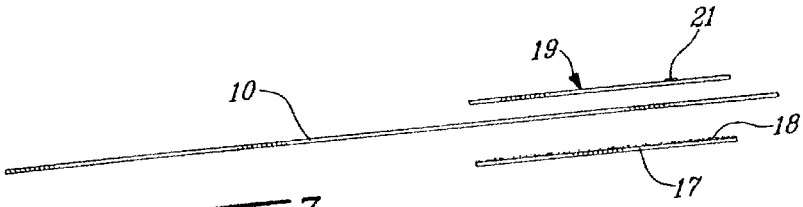
FIG. 7 is a side view of FIG. 6 showing the location of the patches relative to the carrier sheet.
Figure 8:
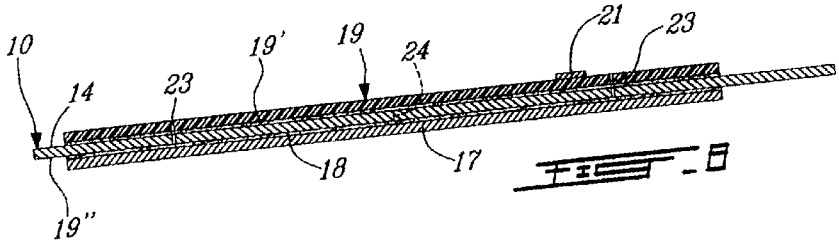
FIG. 8 is an exaggerated section view showing the component parts of the carrier sheet with the integrated magnetic strip card and its die cut.

As shown more clearly in FIGS. 6 to 8, a siliconized liner patch 17 containing a pressure-sensitive adhesive 18 on a surface thereof is laminated on the back surface 19" of the carrier sheet 10 with the adhesive placed on the back surface of the carrier sheet and disposed to extend over the card region 20.

Figure 1:
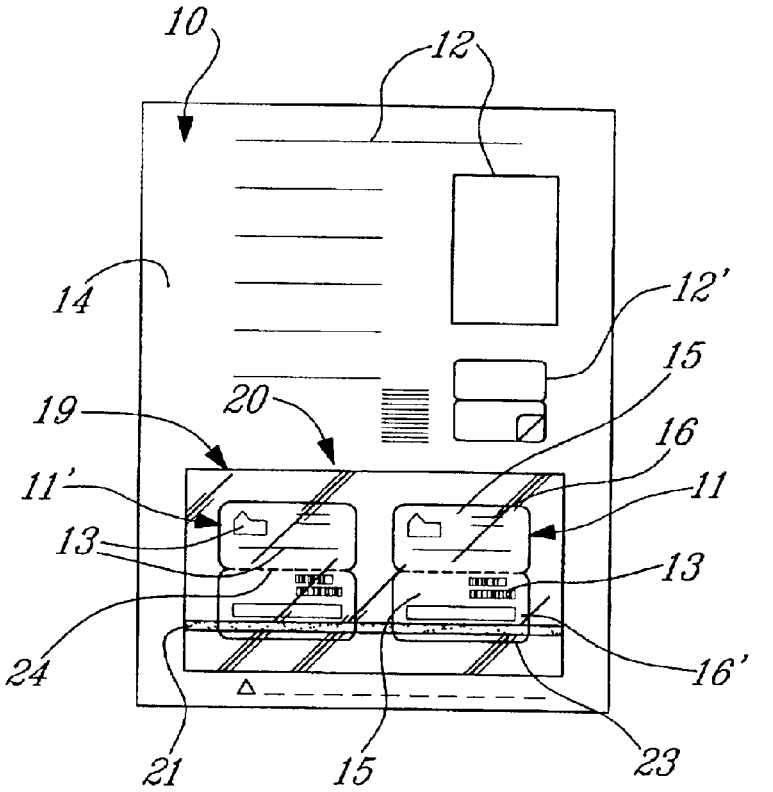
FIG. 1 is a plan view showing a carrier sheet with an integrated magnetic strip card and constructed in accordance with the present invention.

A face patch 19 of clear poly material, such as polyester, polystyrene, etc., containing a magnetic strip 21 is immovably secured over the front face 14 of the carrier sheet 10 and over the card region 20 with the magnetic strip 21 oriented across the rear panel 16' to be formed at a specific location thereon. As shown in FIG. 1, the magnetic strip 21 extends across both rear card panels 16' and entirely across the face patch 19. The face patch may be adhered to the carrier sheet by a hot press or a transparent adhesive whereby it is laminated on the carrier sheet. It is pointed out that both the patches 17 and 19 are very thin films capable of withstanding temperatures of 340° F. to 450° F., as well as the magnetic strip, and do not cause any interference when handled by a printing press or a patch-applying laminating machine. They are also handled in an interference-free manner in laser printers associated with personal PCs. Accordingly, the plastic film is of a type capable to be printed in a laser printer. It is pointed out that the composite carrier sheet can be computer printed using simplex printing (laser, thermal, impact or inkjet). It can also be printed in an offset press.

The carrier sheet 10 as shown in FIG. 6 is further provided with opposed detachable perforated carrier strips 22 for feeding the carrier sheet or form, in the direction of arrow A, in a high-speed printer and a high-speed-patch applicating and butterfly die cutting machine of the type known in the art. Alternatively, the carrier sheet may be in sheet form, such as 8½×11 inch paper sheets. Indexing markings may also be provided on the sheet for synchronous processing in a high-speed printer, patch applicator, die cutting and paper-severing-machine process.

After the patches 17,19 have been laminated on the carrier sheet 10, the sheet undergoes a die cutting process, whereby a butterfly die cut 23 delineates the front and rear card panels disposed adjacent one another, as better shown in FIG. 1, and extends through the face patch 19, the magnetic strip 21 which extends beyond the side edges of the rear card panel 16' and the carrier sheet 10, as better illustrated in FIG. 8. It is pointed out that in FIG. 8 the patches and the carrier sheet as well as the magnetic strips are exaggerated in thickness for ease of illustration and description but as earlier mentioned, these patches as well as the magnetic strips are thin film products. It is also pointed out that the butterfly-type die cut card panels 16 and 16' are retained in the carrier sheet 10 by the pressure-sensitive adhesive 18 which is now transferred to the back surface 19" of the carrier sheet due to pressure having been applied during the printing and patch application process. A straight perforation line 24 is formed in the face patch to form a fold line between the front and rear panels 16 and 16' as better illustrated in FIG. 1.

Figure 2:
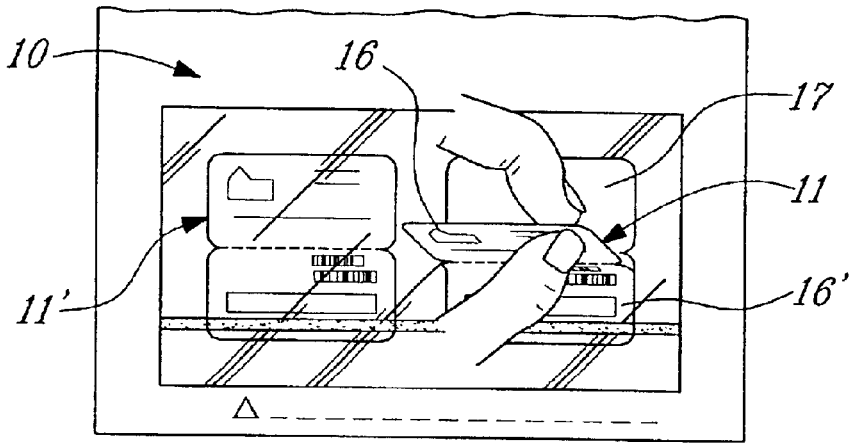
FIG. 2 is a fragmented partly perspective view showing how the card panels are detached from the carrier sheet.
Figure 3:
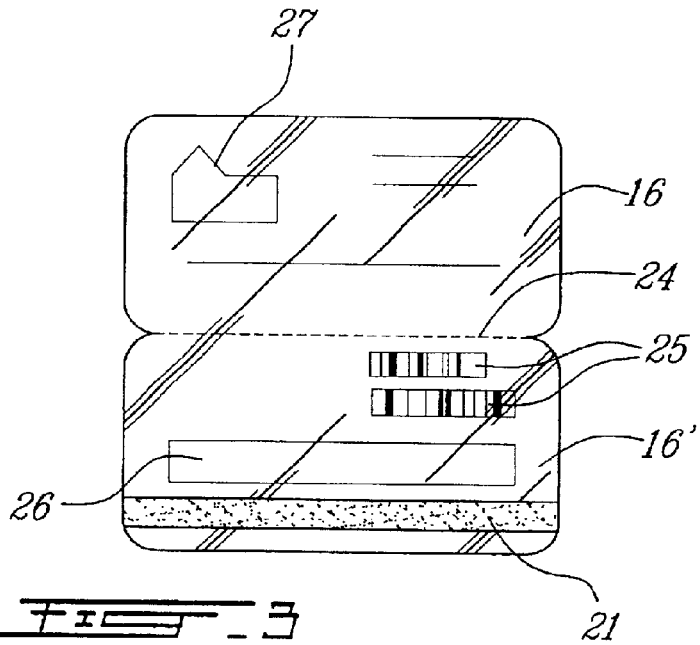
FIG. 3 is a plan view showing the card panels detached from the carrier sheet.
Figure 5:
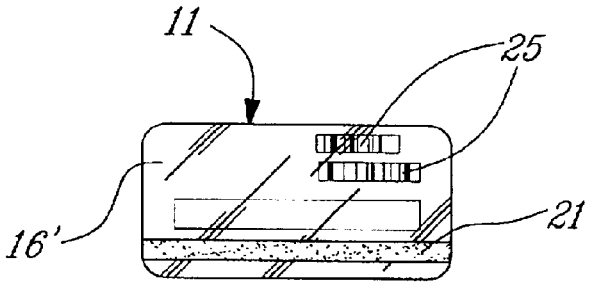
FIG. 5 is a plan view of the plasticized magnetic strip card formed in accordance with the present invention.

Referring now to FIGS. 2 to 5, there is illustrated the method of forming the magnetic strip card 11 and this is accomplished by detaching the front and rear card panels 16 and 16' in the manner as illustrated in FIG. 2 by grasping a corner of the panel and peeling it off the carrier sheet 10 with the pressure-sensitive adhesive 18 having now been stuck on the back surface 19" of the carrier sheet which forms the back face of the card panels. This pressure-sensitive adhesive simply releases from the silicone backing patch as its adherence with the adhesive is minimal as compared to the paper surface. The card panels having now been detached, as shown in FIG. 3, can now be folded on the fold line 24 to position their back adhesive surface juxtaposed to create a permanent bond as illustrated in FIGS. 4 and 5. Accordingly there is now formed a magnetic strip card having a plasticized surface on both sides of the card.

As also illustrated in FIGS. 3 to 5, the printed information on the card surface, herein the rear card panel 16', may include one or more bar codes 25 which may be used to identify the intended user of the card or for various other uses. It is also pointed out that the magnetic strip 21 is compatible for use in an encoder/reader machine to be encoded or read or both read and encoded. A window area 26 may also be printed on the rear panel to receive the signature of the card user person. On the front panel 16 there is usually printed graphics 27 which is customized to the card issuer. The information 12 printed on the carrier sheet may also contain personalized information as well as instructional information shown at 12' instructing the user how to form the plasticized magnetic strip card 11 of the present invention. As earlier described, the carrier sheet 10 as hereinshown contains two of these front and rear panels disposed in side-by-side relationship with the magnetic strip 21 oriented across both of the rear card panels 16'.

Figure 9:
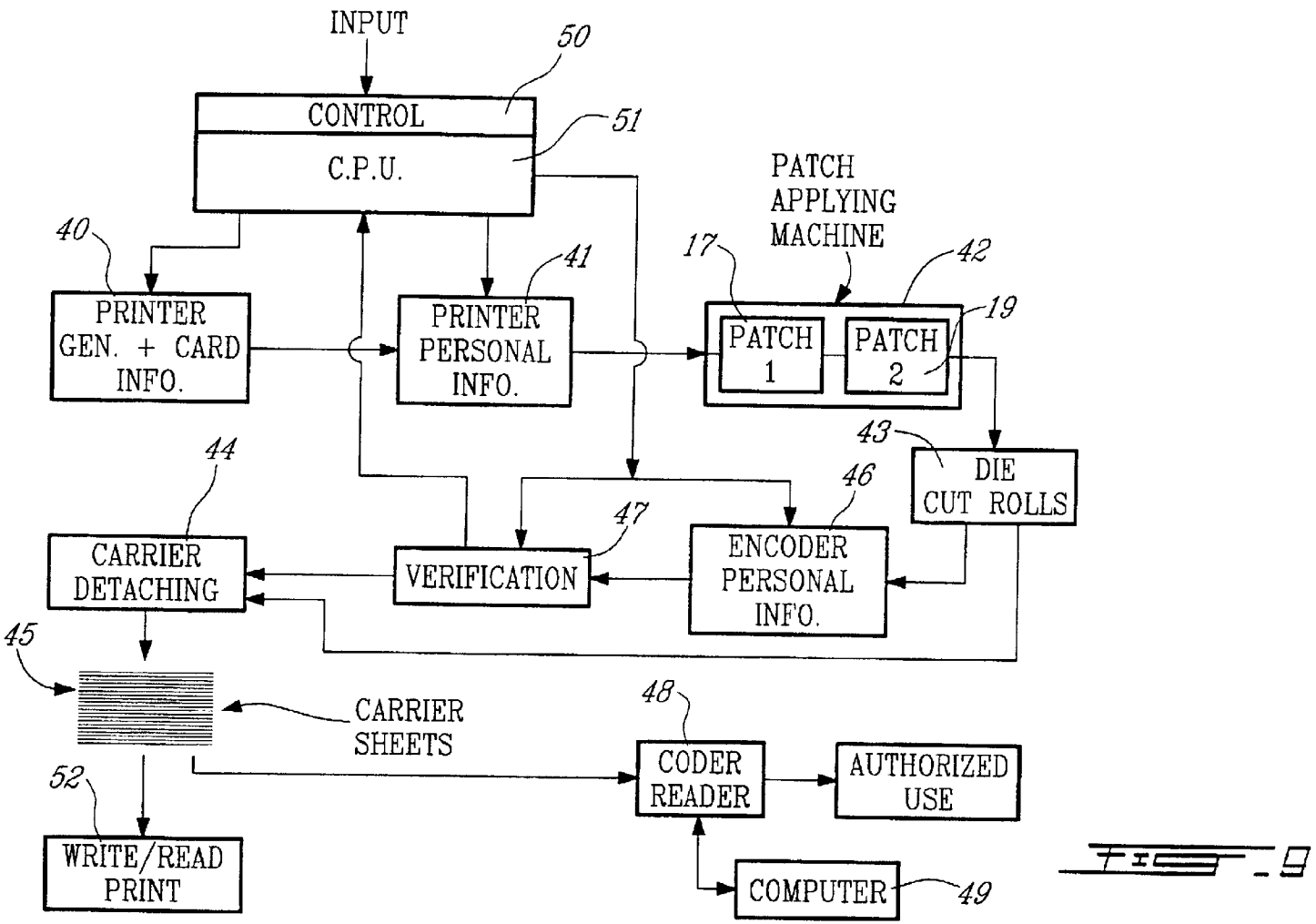
FIG. 9 is a block diagram of a computer control system for the fabrication of the carrier sheet with an integrated magnetic strip card, as well as the printing and encoding of personal information on the carrier sheet and the magnetic strip or simply the production of a carrier sheet with an integrated card or a magnetic strip card which is later automatically encoded for specific use.

With reference now to FIG. 9, there will be disclosed the method of forming the carrier sheet with the integrated detachable magnetic strip card as well as a method of use of the card. In an automated system, it is conceivable that a computer can control the entire manufacturing process. The method comprises printing on the carrier sheet 10 with information 12 containing in part card information printed at a predetermined location on the front face 14 of the carrier sheet and in a card region 20 of the carrier sheet with the printed information oriented to be disposed on an outer surface 15 of the front and rear card panel 16 and 16' respectively of the magnetic strip card to be formed. As shown in FIG. 9, the carrier sheet form 10 may be printed in a printer 40 which is controlled by a control device 50 which includes a computer programmable unit 51 providing a message to be printed on the carrier sheet as well as the disposition of the printed material. Any personalized information contained within the CPU is also printed at a designated location on the carrier sheet by the printer 40. This may be done in a different printing step as shown at 41 in another printer section. After the carrier sheet is printed with the general as well as personalized information, graphics, and bar codes, etc., the patches 17 and 19 are applied to the carrier sheet by a patch applying machine 42. The carrier sheet with the patches laminated thereto are then fed between a die cut roll 43 where the card panel outlines, having butterfly-type cut sections, is die cut into the form to delineate the card panels. This process can then be fed directly to a carrier detaching mechanism 44 wherein the carrier sheets with the integrated detachable magnetic strip card are released into a stack form 45. Alternatively, after the die cut roll, the form may be fed into an encoder 46 wherein a user code, as well as other personalized information, is encoded into the strip. The carrier sheet can then be fed to a verification reader device 47 to verify all of the information on the form with the CPU 51. The carrier sheet form is then fed to the carrier detaching machine 44.

The stack of carrier sheets 45, with uncoded magnetic strips and unpersonalized information on the card, can then be forwarded to intended users wherein the card can then be utilized in a coding machine 48 whereby an encrypted code can be encoded to the magnetic strip to provide authorized use of the card. The coding machine 48 is connected to the central computer 49 of the card issuer. Alternatively, the personalized carrier sheets including an encoded message in the magnetic strip can be forwarded to the intended user and placed into a write/read/print machine 52 for automatic processing.

It is further pointed out that the carrier sheet may contain printed information which is impersonalized and a customer would then print personalized information in designated areas for his customized use.

Figure 10:
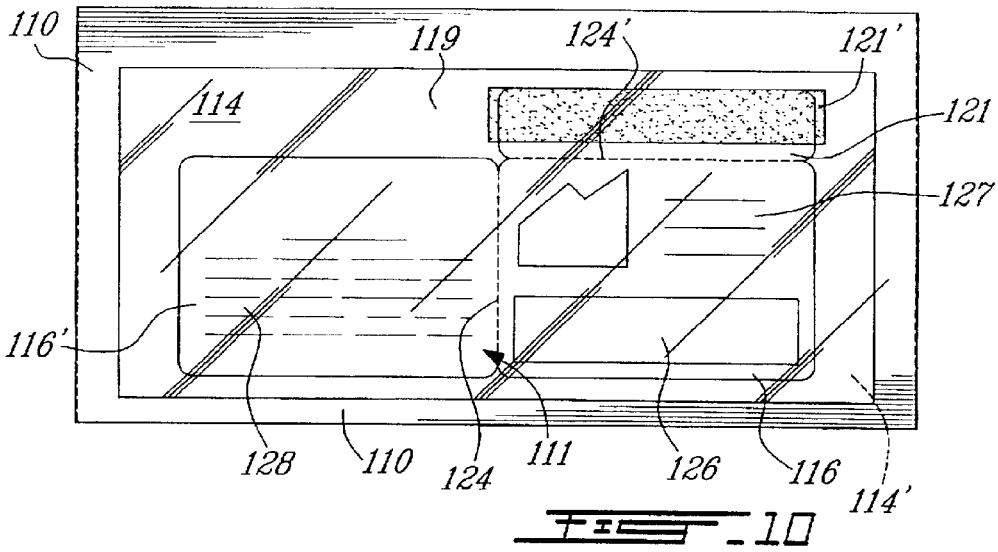
FIG. 10 is top plan view showing a carrier sheet in accordance with a further embodiment of the present invention.

Referring now to FIG. 10, another embodiment in accordance with the present invention is shown. This embodiment involves a carrier sheet panel 110 of a continuous fan-folded bundle. The panels 110 have a front face 114 and a rear face 114'. The carrier sheet panel 110 has the shape of an airline boarding card provided with an integrated magnetic strip card 111 formed integral therewith. The carrier sheet fan-folded bundle may be stored in a kiosk-type card printing and dispensing machine. The three panel card 111 provides sufficient thickness in magnetic stripe region when folded, i.e. in the range of 24–30 thousandth of an inch, for handling by reading machines.

Figure 11:
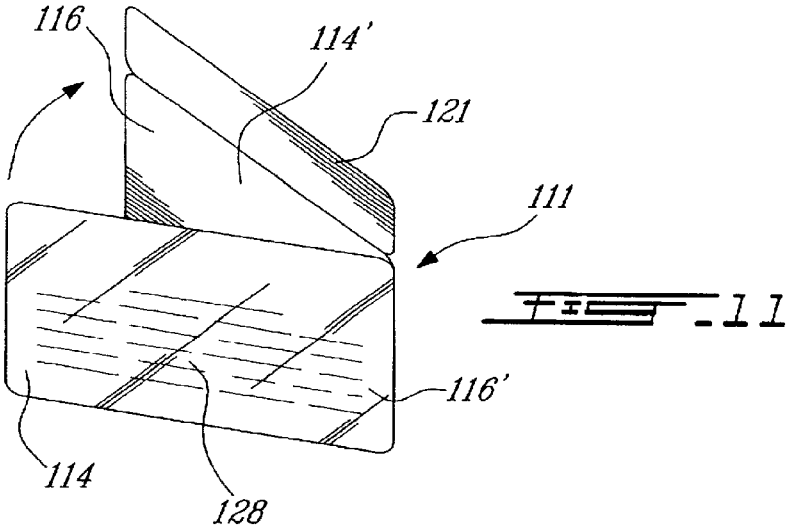
FIG. 11 is a perspective view showing a first sequence of how the card panels are folded together to form a plasticized card.
Figure 12:
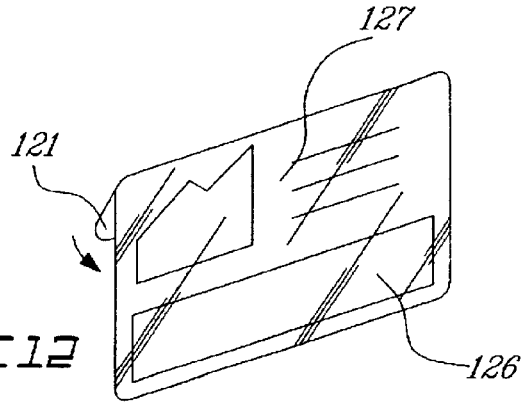
FIG. 12 is a further perspective view showing a further sequence of how the card panels are folded together to form a plasticized card.

As best shown in FIGS. 11 and 12, the magnetic strip card 111 is formed from a front panel 116, a rear panel 116' and a magnetic strip panel 121. The front panel 116 and the rear panel 116' may be illustrated according to the card issuer's requirements. For instance, the front panel 116 of FIG. 10 is shown having a window area 126, wherein card user information may be printed, such as a name and/or an identification number. Also, printed graphics 127 and 128 may be customized to the card issuer.

A face patch 119 of clear material, same as hereinabove disclosed, is secured to the front face 114 of the carrier sheet 110 by a hot press or a transparent adhesive, whereby it is laminated thereon. Thereafter, a magnetic strip patch 121' is applied on the face patch 119 of the carrier sheet 110, such as to be positioned across the magnetic strip panel 121.

A siliconized liner patch containing a pressure-sensitive adhesive (not shown) is applied on the rear surface 114' of the carrier sheet 110. The carrier sheet 110 is then fed through a butterfly die cutting machine, such as to delineate the front panel 116, the rear panel 116' and the magnetic strip panel 121. It is pointed out that the butterfly-type die cut panels are retained in the carrier sheet 110 by the pressure sensitive adhesive of the permanent adhesive patch transparent to rear face 114'. It is also noted that the front panel 116 and the rear panel 116' are interconnected at a common edge 124, whereas the front panel 116 is connected to the magnetic strip panel 121 at a common edge 124'. Although the panels are herein shown as delineated by a butterfly cut, the panels may be straight cut to form a perfect rectangular card.

Referring to FIGS. 11 and 12, there is illustrated the method of forming the magnetic strip card 111. This is accomplished by detaching the front panel 116, the rear panel 116' and the magnetic strip panel 121 from the carrier sheet 110 by grasping a corner of either panel and peeling them off the carrier sheet 110 with the pressure sensitive adhesive having now been stuck on the back surface 114' of the carrier sheet 110, which forms the back face of the card panels. The card panels having been detached, the rear panel 116' may be folded on the front panel 116 at the common edge 124 as shown in FIG. 11, to juxtapose their back adhesive surfaces to create a permanent bond, as illustrated in FIG. 12. Thereafter, the magnetic strip panel 121 may be folded on to the rear panel 116' along he common edge 124'.

It is pointed out that some overlapping is intended for the portion of the card in the area of the magnetic strip 121' to be thick enough for magnetic strip reading. For instance, the magnetic strip card may be used as a temporary card product, wherefore the magnetic strip is passed through a reader/encoder device for encoding information thereon.

The card is thus encoded for application use, such as for airline loyalty services, e-commerce cash card or the like. In respect to the airline loyalty services, the carrier 110 may have rectangular square punch holes at specific locations whereby thermal printers and like equipment located at sales service counters are accommodated.

EXAMPLE 1

A typical example of the use of the carrier sheet and integrated magnetic strip card of the present invention is for the travel industry and particularly for the booking of cruises. For example, when a person books a cruise through a cruiseline or a travel agent, his/her personal information concerning its identity, as well as personal event request is stored in a computer such as the CPU 51 shown in FIG. 9. The event schedule information, as well as the customer identity information makes it possible for the CPU to print the customer identity information onto the carrier sheet in the printer 40, as well as other personal information, such as the person's name which could appear on the card panels. The panels may be printed in the printer 41. The magnetic strip is then encoded in the encoder 46 with a user code as well as other coded information which could be generated depending on the event schedule information stored in the computer. The user code will permit the user to access the stored computer information at an event location. The carrier sheet and the integral magnetic strip card is forwarded to the customer or end user who detaches the card from the carrier sheet in the fashion as previously described. The customer thus possesses one or two or more customized and plasticized magnetic strip cards and when arriving at the scheduled event, such as a port of departure of a cruise ship, the customer enters his personalized card in a magnetic strip card reader such as the write/read laser printer system 52 or a coder reader such as 48, and the user code provides access to the central computer 49 or 51 of the cruiseline to download to the user information concerning the specific room that he/she has been assigned on the ship, and the location of the room and other information. Simultaneously, the computer could also code the magnetic strip to activate the card so that the card user may use the card throughout the paying events on the cruiseliner for automatic billing by the computer system. The card also records the arrival of the customer at the event location so that the computer system can automatically effect the management of all bookings. This greatly facilitates the handling of the customers which is usually time consuming as large numbers of customers must be processed before a ship can depart from the harbour. The ships often contain 2000 to 4000 passengers and it could take as long as eight to twelve hours to process that many people. With this computer system, the processing would be done virtually automatically and practically error free.

EXAMPLE 2

In another embodiment, cards without magnetic strips in the patch may be integrally formed with the carrier sheet. For example, a telephone company could issue a card to a person with the person's name appearing on the card together with a personal access code. The carrier sheet contains instructions for using the card together with a toll-free telephone number, wherein the person receiving the card may dial the telephone number to activate the card by the personal access code and the person's pin number. The card can then be sent to someone you want to receive a call from at your expense and at a lower rate depending on the applicable time that the call is made. Such a system would provide to the card holder, the enjoyment of pre-paid long distance rate. The telephone company could offer the best available savings based on your long-distance savings plan and have no call connection fees for calls made from within a country without the assistance of an operator. You can also receive overseas calls with the assistance service by dialing an 800 number with no risk of call blocking.

The above examples are only to indicate a few uses of the carrier sheet with integrated card and there are countless other uses imaginable.

It is within the ambit of the present invention to cover any obvious modifications of the preferred embodiment described therein, provided such modifications fall within the scope of the appended claims.

We claim:

1. A carrier sheet with an integrated card, said carrier sheet having printed information thereon, said printed information containing card information printed at a predetermined location on a front face of said carrier sheet in a card region of said sheet and oriented to be disposed on an outer surface of at least one of a front and a rear card panel of a card to be formed, a siliconized liner patch containing a pressure-sensitive adhesive surface is laminated on a back surface of said carrier sheet and disposed to extend over said card region, a face patch of clear poly material is immovably secured over said card region on said front face of said carrier sheet, a magnetic strip patch is immovably secured over said card region on an outer surface of a magnetic strip panel, a die cut delineates said front and rear card panels disposed adjacent one another and said magnetic strip panel adjacent said front panel, said die cut extending through said face patch and said carrier sheet; said die cut card panels being retained in said carrier sheet by said pressure sensitive adhesive of said siliconized liner patch, and straight fold lines in said face patch between said front and rear card panels and between said magnetic strip panel and said front card panels, said card being formable by peeling off said panels from said carrier sheet with said pressure-sensitive adhesive releasing from said siliconized liner patch whereby said adhesive now lies on a back face of said card panels, and folding said panels along said straight fold lines to firstly mate said back face of said front and rear card panels and then said back face of said magnetic strip panel on said rear card panel.

2. A carrier sheet as claimed in claim 1, wherein said magnetic strip is disposed spaced and parallel to an edge of said rear panel.

3. A carrier sheet as claimed in claim 1, wherein said carrier sheet is a paper printed form having opposed detachable perforated carrier strips for feeding same in a high speed printer and patch applying and a butterfly die cutting machine.

4. A carrier sheet as claimed in claim 1, wherein said magnetic strip is compatible for use in an encoder/reader machine to be encoded or read or both read and encoded.

5. A carrier sheet as claimed in claim 1, wherein said carrier sheet is a paper sheet detachable panel of a plurality of fan-folded sheet panels.

6. A carrier sheet as claimed in claim 1, wherein said magnetic strip contains personalized information, said magnetic strip being an encoded magnetic strip.

7. A method of forming a carrier sheet having an integrated detachable card, said method comprising the steps of:

i. Printing a carrier sheet with information containing card information printed at a predetermined location on a front face of said carrier sheet in a card region of said carrier sheet and oriented to be disposed on an outer surface of at least one off a front and rear card panel of a card to be formed, ii. applying a siliconized liner patch containing a pressure-sensitive adhesive surface on a back surface of said carrier sheet and attached by said adhesive to extend over said card region, iii. securing a face patch of clear poly material and a magnetic strip patch over said card region on said front face of said carrier sheet, iv. die cutting said front card panel, said rear card panel and a magnetic strip panel in said card region, said die cut extending through said face patch, said magnetic strip patch and said carrier sheet whereby said die cut panels adjacent one another are solely retained in said carrier sheet by said pressure sensitive adhesive on said siliconized liner patch on said back surface of said sheet, and v. forming a straight fold line in said face patch between said front and rear card panels and front card panel and magnetic strip panel to permit said adjacent card panels to be folded together on their back faces along said fold line when said adjacent die cut card panels are peeled off said siliconized liner patch with the pressure-sensitive adhesive on their back surface.

8. A method of forming a carrier sheen as claimed in claim 7, wherein said step (iii) includes orienting said magnetic strip across said magnetic strip panel and heat sealing said face patch on said card region.

9. A method of forming a carrier sheet as claimed in claims 7 and 8, wherein there is further provided before step (i) inputting personalized data in a computer programmable unit whereby said step (i) comprises printing personalized information.

10. A method of forming a carrier sheet as claimed in claim 7, wherein there is further provided the step of encoding said magnetic strip with personalized information and verifying said personalized information.

* * * * *